US006861952B1

(12) United States Patent
Billmaier

(10) Patent No.: US 6,861,952 B1
(45) Date of Patent: Mar. 1, 2005

(54) APPARATUS AND METHOD FOR UTILIZING SMOKE ALARMS AS NODES OF A HOME NETWORK

(75) Inventor: James A. Billmaier, Woodinville, WA (US)

(73) Assignee: Digeo, Inc., Kirkland, WA (US)

( * ) Notice: Subject to any disclaimer, the term of this patent is extended or adjusted under 35 U.S.C. 154(b) by 40 days.

(21) Appl. No.: 10/184,023

(22) Filed: Jun. 26, 2002

(51) Int. Cl.[7] ..... G08B 1/00
(52) U.S. Cl. ..... 340/531; 340/521; 340/286.02
(58) Field of Search ..... 340/531, 426.24, 340/517, 521, 286.02, 286.05, 287, 532, 533, 535, 540, 628; 356/438

(56) References Cited

U.S. PATENT DOCUMENTS 6,281,790 B1 * 8/2001 Kimmel et al. ..... 340/506
6,624,750 B1 * 9/2003 Marman et al. ..... 340/506

OTHER PUBLICATIONS

How Smoke Detectors Work, URL=http://www.howstuffworks.com/smoke.htm, download date Jun. 18, 2002.

* cited by examiner

*Primary Examiner*—Jeffery Hofsass
*Assistant Examiner*—Jennifer A. Stone

(57) ABSTRACT

An apparatus for providing hub functionality in a local network, includes: a smoke detector including a detector module configured to provide smoke detection functionality, and a hub module coupled to detector module and configured to provide network hub functionality. A method of providing hub functionality in a local network, includes: providing a smoke detector including a detector module configured to provide smoke detection functionality, and a hub module coupled to detector module and configured to provide network hub functionality; and transmitting a packet from one segment to another segment by use of the smoke detector.

25 Claims, 4 Drawing Sheets

APPARATUS AND METHOD FOR UTILIZING SMOKE ALARMS AS NODES OF A HOME NETWORK

BACKGROUND OF THE INVENTION

1. Field of the Invention

The present disclosure relates generally to the field of local area networks, and more particularly but not exclusively, to an apparatus and method for utilizing smoke alarms as nodes of a home network.

2. Description of the Related Art

In the evolution of the information age, there has been a rapid growth in the use of the Internet and an increased availability of audio, video, and other bandwidth-intensive content for delivery to processing devices, such as personal computers (PCs) and set top box devices. Within the home environment, there is an increasing need for home networks (e.g., local area networks) that enable communications among electronic and electric systems to permit further functionalities for these systems. Existing technologies permit broadband wired or wireless products to receive and deliver video and audio content, and permit the distribution of broadband Internet content from a PC to televisions, stereos, and other electronic entertainment devices within the home.

Existing technologies also provide home automations systems that control security, lighting, heating, and air conditioning systems. Various vendors provide at least some products or solutions that are of the type described above (e.g., X10 Wireless Technology, Inc., Seattle, Wash. 98188<www.X10.com> and Smarthome, Inc., 17171 Daimler St., Irvine, Calif. 92614-5508 <www.smarthome.com>).

Innovation will be required for home networks so that these networks can support the features and advancements in home entertainment systems and home automation systems. Current approaches and/or technologies are limited to particular capabilities and suffer from various constraints.

BRIEF DESCRIPTION OF THE SEVERAL VIEWS OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

In the description herein, numerous specific details are provided, such as examples of components and/or methods, to provide a thorough understanding of embodiments of the invention. One skilled in the relevant art will recognize, however, that an embodiment of the invention can be practiced without one or more of the specific details, or with other apparatus, systems, methods, components, materials, parts, and/or the like. In other instances, well-known structures, materials, or operations are not shown or described in detail to avoid obscuring aspects of the invention.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As an overview, an embodiment of the present invention includes an apparatus for providing hub functionality in a local network, the apparatus comprising: a smoke detector including a detector module configured to provide smoke detection functionality, and a hub module coupled to the detector module and configured to provide network hub functionality.

In another embodiment, an apparatus for providing a local network includes: a plurality of segments configured to transmit data; and a smoke detector coupled to at least some of the segments, the smoke detector including a detector module configured to provide smoke detection functionality, and a hub module coupled to the detector module and configured to provide network hub functionality.

In yet another embodiment, a method of providing hub functionality in a local network includes: providing a smoke detector including a detector module configured to provide smoke detection functionality, and a hub module coupled to the detector module and configured to provide network hub functionality; and transmitting a packet from one segment to another segment by use of the smoke detector.

In yet another embodiment, a method of processing signals in a network includes: receiving, by a hub, a packet from a first segment, the hub including smoke detection functionality; copying the received packet from a first port to a second port of the hub; and transmitting the packet from the second port to at least another segment.

These and other features of various embodiments of the present invention will be readily apparent to persons of ordinary skill in the art upon reading the entirety of this disclosure, which includes the accompanying drawings and claims.

Figure 1:
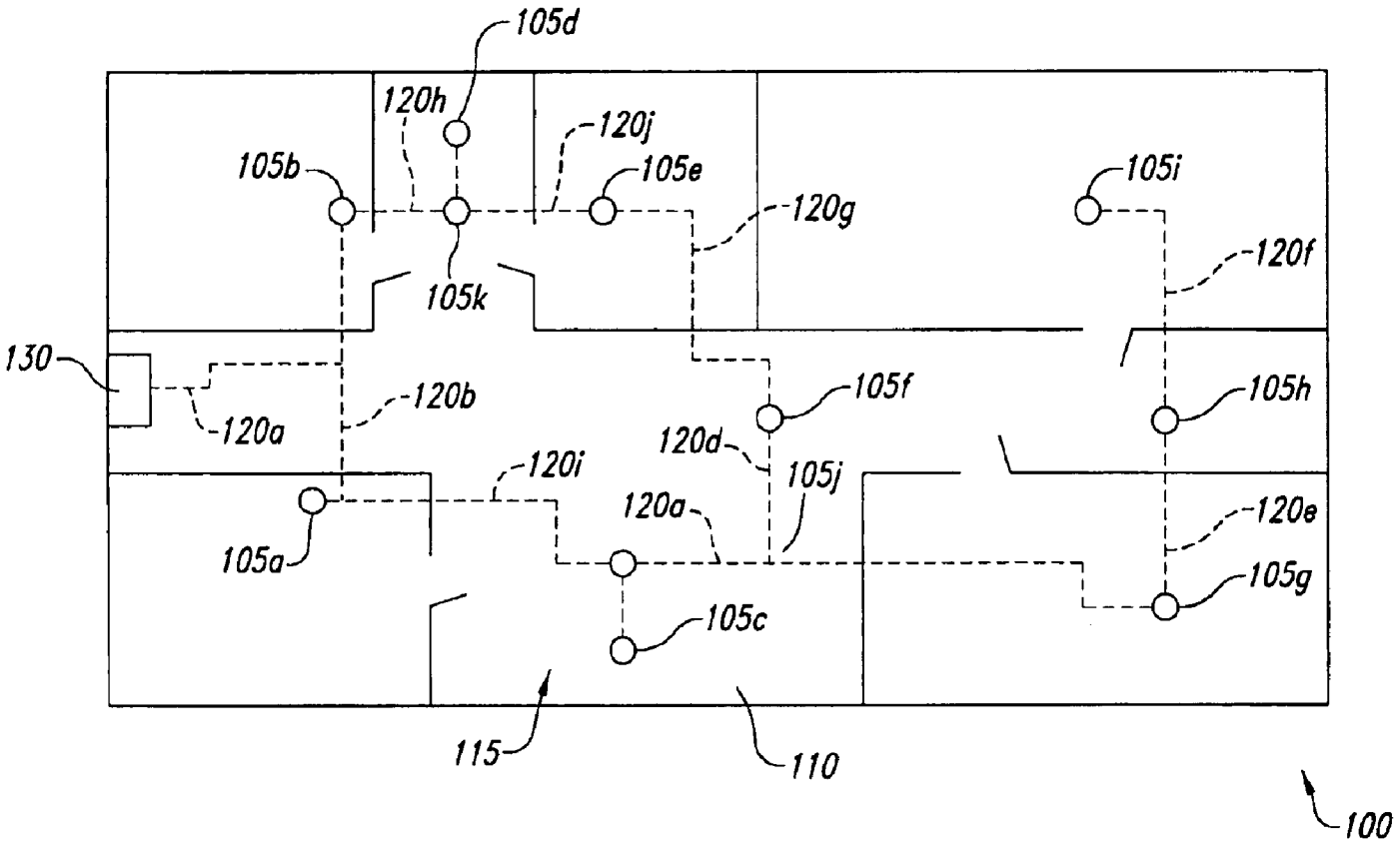
FIG. 1 is a top plan view of a structure that can implement an embodiment of the invention.

FIG. 1 is a top plan view of a structure 100 that can implement an embodiment of the invention. The structure 100 may be, for example, a house or other dwelling or building. Several smoke detectors 105*a* to 105*k* are disposed in various areas of the structure 100. For example, at least one of the smoke detectors is coupled to or integrated with a ceiling 110 of the structure 100.

The smoke detectors 105*a–k* can comprise photoelectric smoke detectors that use a light source and a photodetector sensor. When smoke is present, the smoke scatters the light emitted by the light source, causing some of the scattered light to hit the photodetector sensor, which triggers an alarm. Alternatively or in addition, the smoke detectors 105*a–k* can comprise ionization smoke detectors that use an ionization chamber and a source of ionization radiation to detect smoke. When smoke is present, the smoke particles attach to atoms ionized by the ionization radiation and neutralize them—the smoke detector then senses a drop in electrical current (which would otherwise be flowing freely in the absence of smoke), and triggers an alarm.

It is appreciated that other types of smoke detectors 105*a–k*, which may or may not be based on the same technology as photoelectric or ionization smoke detectors, may be used in the structure 100. These include, but are not limited to, high performance optical (HPO) detectors, heat detectors, optical beam detectors, carbon monoxide (CO) fire detectors, and so forth.

In one embodiment, in addition to being able to perform conventional smoke detection functions and/or alarm functions, each of the smoke detectors 105*a–k* functions as a hub for a network 115 that is implemented by segments (or links) 120*a* to 120*j*. Of course, the illustrated network topology is provided for example purposes only, and other network topologies may be used within the scope of the invention. Additionally, it is not a requirement that each smoke detector 105 functions as a network hub. For example, every third or fourth smoke detector 105 may act as a network hub, while the other detectors perform only conventional detection functions.

In an embodiment, the smoke detectors 105 have wiring connected to an alarm panel 130. Typically, smoke detectors in alarm systems in modern buildings, residential dwellings, and/or other structures have power connections to an alternating current (AC) power source and only use batteries as a backup source. In additions, these smoke detectors typically have wiring connected to alarm panels, such as the alarm panel 130 in the example of FIG. 1. As a result, the wiring or routing for connecting the smoke detectors to the alarm system is often closely adjacent to the wiring of a network such as a home network.

In an embodiment of the invention, by placing circuitry (see, e.g., a hub module 210 in FIG. 2) for a network hub in a smoke detector 105 (e.g., the smoke detector 105*h*), power and network connections can be provided to the network 115 by the smoke detector 105. As discussed below, the smoke detector 105 can provide hub functionality by providing wired or wireless hub connection to the network 115.

The network 115 may be, for example, a Local Area Network (LAN), a home network, or another type of network that can be implemented for functionality within the structure 100. As known to those skilled in the art, a LAN is a computer network that spans a relatively small area. Most LANs are confined to a single building or group of buildings. However, one LAN can be connected to other LANs over any distance via telephone lines and radio waves. A system of LANs connected in this way is called a wide-area network (WAN). Typically, most LANs connect workstations and personal computers. Each node (individual computer) in a LAN has its own processor (e.g., central processing unit or CPU) with which the node executes programs, but the node also is able to access data and devices anywhere on the LAN. This permits many users to share expensive devices, such as laser printers, as well as data. Users can also use the LAN to communicate with each other, by sending e-mail or engaging in chat sessions. There are many different types of LANs, with Ethernet LANs being the most common local networks for personal computers (PCs). Most Apple Macintosh networks are based on the AppleTalk™ network system from Apple Computer Corporation, which is built into Macintosh computers.

The following characteristics differentiate one LAN from another:

(1) Topology: This is a geometric arrangement of devices on the network. For example, devices can be arranged in a ring or in a straight line.

(2) Protocols: These are rules and encoding specifications for sending data. The protocols also determine whether the network uses a peer-to-peer or client/server architecture.

(3) Media: Devices can be connected by twisted-pair wire, coaxial cables, or fiber optic cables. Some networks communicate via wireless communication methods.

LANs are capable of transmitting data at very fast rates, and these rates are much faster than the data transmission rates over a telephone line. However, the distances covered by a LAN are limited, and there is also a limit on the number of computers that can be attached to a single LAN. Thus, in an embodiment of the invention, by adding network hub functionality in a smoke detector 105 in FIG. 1, the distance covered by a LAN, such as network 115, can be advantageously increased.

The Ethernet is a local-area network (LAN) architecture that uses a bus or star topology and supports data transfer rates of, for example, 10 megabits per second (Mbps), and is one of the most widely implemented LAN standards. The Ethernet specification served as the basis for the IEEE 802.3 standard, which specifies the physical and lower software layers. The Ethernet uses the carrier sense multiple access/collision detection (CSMA/CD) access method to handle simultaneous demands.

The 10Base-T standard (also commonly known as the Twisted Pair Ethernet) is one of several adaptations of the Ethernet (IEEE 802.3) standard for LANs. The 10Base-T standard uses a twisted-pair cable with maximum lengths of 100 meters. The cable is thinner and more flexible than the coaxial cable used for the 10Base-2 or 10Base-5 standards. Cables in the 10Base-T system typically connect with RJ45 connectors. A star topology is common with 12 or more computers connected directly to a hub or concentrator. The 10Base-T system operates at about 10 Mbps and uses baseband transmission methods.

A version of Ethernet, known as 100Base-T (or Fast Ethernet), supports data transfer rates of 100 Mbps. Another version of Ethernet, known as Gigabit Ethernet, supports data rates of 1 gigabit (1,000 megabits) per second.

As stated above, at least one of the smoke detectors 105*a–k* in FIG. 1 may be configured to include network hub functionality in order to provide power and/or data transmission capability or hub capability to the network 115. A network hub is a common connection point for devices in a network. Hubs are commonly used to connect segments of a LAN. A hub typically includes multiple ports. When a packet arrives at one port, it is copied to the other ports so that all segments of the LAN can see all packets. A passive hub serves simply as a conduit for the data, enabling it to go from one device (or segment) to another. In contrast, an intelligent hub includes additional features that enable an administrator to monitor the traffic passing through the hub and to configure each port in the hub. Intelligent hubs are also commonly known as manageable hubs. A third type of hub, known as a switching hub, actually reads the destination address of each packet and then forwards the packet to the correct port.

In networks technology, a "segment" is a section of a network that is typically bounded by bridges, routers, or switches. Dividing an Ethernet local area network (LAN) into multiple segments is one of the most common ways of increasing available bandwidth on the LAN. If segmented correctly, most network traffic will remain within a single segment, enjoying the full bandwidth supported by the media. Hubs and switches are typically used to interconnect computers within each segment, and switches can also interconnect multiple segments through the use of virtual LANs (VLANs).

In the example of FIG. 1, the network 115 includes segments 120*a–j*. As stated above, any one of the segments 120*a–j* may be a wired path or wireless path. An example of a wired segment path has been previously described above.

In another embodiment, any one of the segments may be implemented as a wireless media that use a wireless transmission protocol. The wireless transmission method can, for example, permit the transmission of data from one segment to a hub to another segment. There are various suitable wireless transmission standards that can be used to transmit data in the network 115 in accordance with an embodiment of the invention. For example, the Institute of Electrical and Electronics Engineers (IEEE) 802.11 Wireless Networking Standards provide various suitable wireless transmission standards. The IEEE 802.11 standards are a family of specifications developed by the IEEE for wireless LAN technology. The IEEE 802.11 standards specify an over-the-air interface between a wireless client and a base station or between two wireless clients. There are several specifications in the 802.11 family:

(1) 802.11 relates to wireless LANs and provides 1 or 2 Mbps transmission in the 2.4 GHz band using either frequency hopping spread spectrum (FHSS) or direct sequence spread spectrum (DSSS).

(2) 802.11a is an extension to 802.11 that applies to wireless LANs and provides up to 54 Mbps in the 5 GHz band. 802.11a uses an orthogonal frequency division multiplexing encoding scheme rather than FHSS or DSSS.

(3) 802.11b (also referred to as 802.11 High Rate or Wi-Fi) is an extension to 802.11 that applies to wireless LANS and provides 11 Mbps transmission (with a fallback to 5.5, 2 and 1 Mbps) in the 2.4 GHz band. 802.11b typically uses only DSSS. 802.11b allows wireless functionality comparable to Ethernet.

(4) 802.11g relates to wireless LANs and provides 20+ Mbps in the 2.4 GHz band.

Another wireless transmission standard that can be used to transmit data in the network 115 is home radio frequency (or HomeRF). HomeRF is designed specifically for wireless networks in homes—in contrast to 802.11, which was created for use in businesses. HomeRF networks are designed to be more affordable to home users than other wireless technologies. Based on frequency hopping and using radio frequency waves for the transmission of voice and data, HomeRF typically has a range of up to about 150 feet. HomeRF uses Shared Wireless Access Protocol (SWAP) for wireless voice and data networking in the home. SWAP works together with the Public Switched Telephone Network (PSTN) network and the Internet through existing cordless telephone and wireless LAN technologies. SWAP supports time division multiple access (TDMA) for interactive data transfer and CSMA/CA for high-speed packet transfer. SWAP typically operates in the 2400 MHz band at 50 hops per second. Data travels at a rate between 1 Mbps and 2 Mbps. On a SWAP network via cordless handheld devices, users will be able to voice activate home electronic systems; access the Internet from anywhere in the home; and forward fax, voice and e-mail messages.

Another wireless transmission standard that can be used to transmit data in the network 115 is the "Bluetooth protocol," which is a computing and telecommunications industry specification that describes how mobile phones, computers, and personal digital assistants (PDAs) can easily interconnect with each other and with home and business phones and computers using a short-range wireless connection. Using this technology, users of cellular phones, pagers, and PDAs (such as the PalmPilot™) will be able to buy a three-in-one phone that can double as a portable phone at home or in the office, get quickly synchronized with information in a desktop or notebook computer, initiate the sending or receiving of a fax, initiate a print-out, and in general, have all mobile and fixed computer devices be totally coordinated.

Bluetooth requires that a low-cost transceiver chip be included in each device. In an embodiment, this transceiver chip can be implemented in the hub module 210 (see, e.g., FIG. 2) in a smoke detector. The transceiver transmits and receives in a previously unused frequency band of 2.45 GHz that is available globally (with some variation of bandwidth in different countries). In addition to data, up to three voice channels are available, as an example. Each device has a unique 48-bit address from the IEEE 802 standard. Connections can be point-to-point or multipoint. The maximum range is 10 meters, as an example. Data can be exchanged at a rate of 1 megabit per second (up to 2 Mbps in the second generation of the technology), as an example. A frequency hop scheme allows devices to communicate even in areas with a great deal of electromagnetic interference. Built-in encryption and verification is provided. Thus, the Bluetooth protocol can simplify communications among networked devices and between devices and the Internet. The Bluetooth protocol also aims to simplify data synchronization between networked devices and other computers.

Other wireless transmission standards that can be used to transmit data in the network 115 can include, for example, Digital Enhanced Cordless Telecommunications (DECT) technology, or the Apple Airport™ wireless transmission system. It is appreciated that other suitable techniques and standards usable by an embodiment of the invention would be familiar to those skilled in the art having the benefit of this disclosure.

Figure 2:
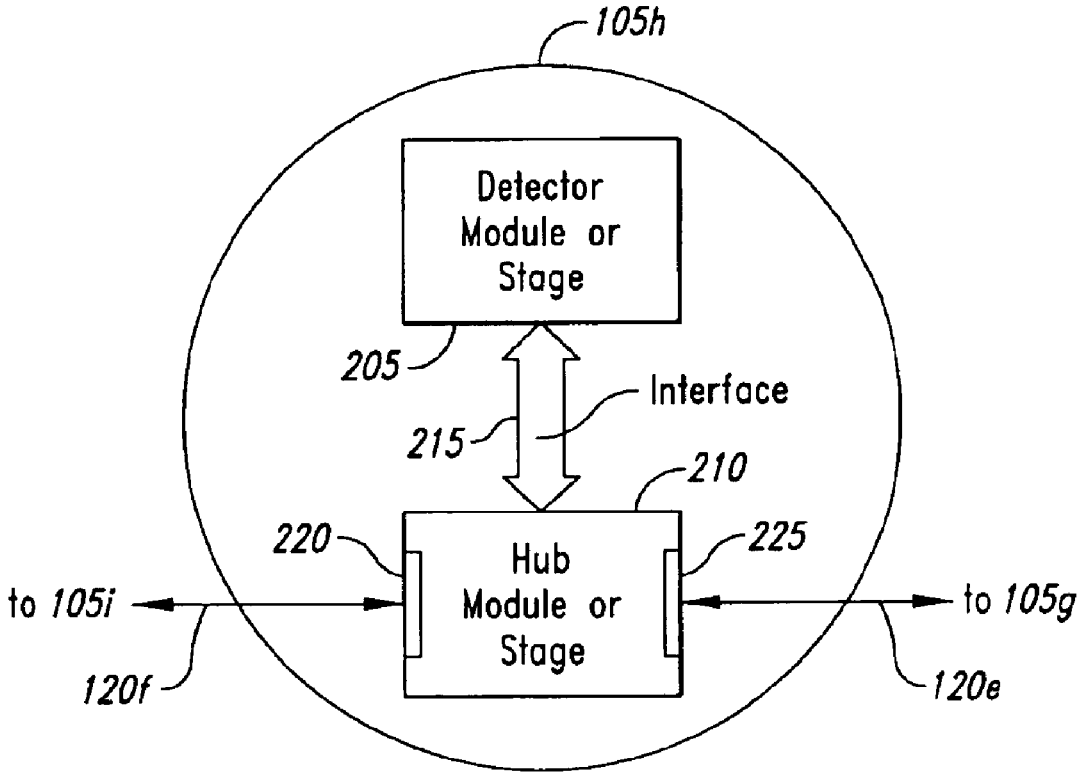
FIG. 2 is a block diagram of a network hub with smoke detection functionality, in accordance with an embodiment of the invention.

FIG. 2 is a block diagram of a network hub (e.g., the smoke detector 105*h*) with smoke detection functionality, in accordance with an embodiment of the invention. The features and functionalities shown or described with respect to FIG. 2 may be implemented in any one or all of the smoke detectors 105*a–k* of FIG. 1. In an embodiment, the smoke detector 105*h* includes a detector module 205 (or stage 205) that permits standard smoke detection and/or alarm functionality. The smoke detector 105*h* also includes a hub module 210 (or stage 210) that permits network hub functionalities as described above. Typically, the hub module 210 includes multiple ports 220 and 225 and/or other ports. When a packet arrives at one port (e.g., the port 220), the packet is copied to the other ports (e.g., the port 225) so that all segments of the network 115 are typically able to see all packets. In the example of FIG. 2, if a packet arrives via the segment 120*f*, then the port 220 can receive the packet. The hub module 210 can copy the received packet to the port 225 so that the packet may be transmitted via the segment 120*e*.

An interface 215 may be used to permit communication between or functionality among the detector module 205 and hub module 210. It is noted that the functionalities in the detector module 205 and hub module 210 may be integrated in a single module or circuitry in one embodiment. The detector module 205 and hub module 210 are shown as separate stages in the example of FIG. 2 for purposes of describing a functionality of an embodiment of the invention.

Figure 3:
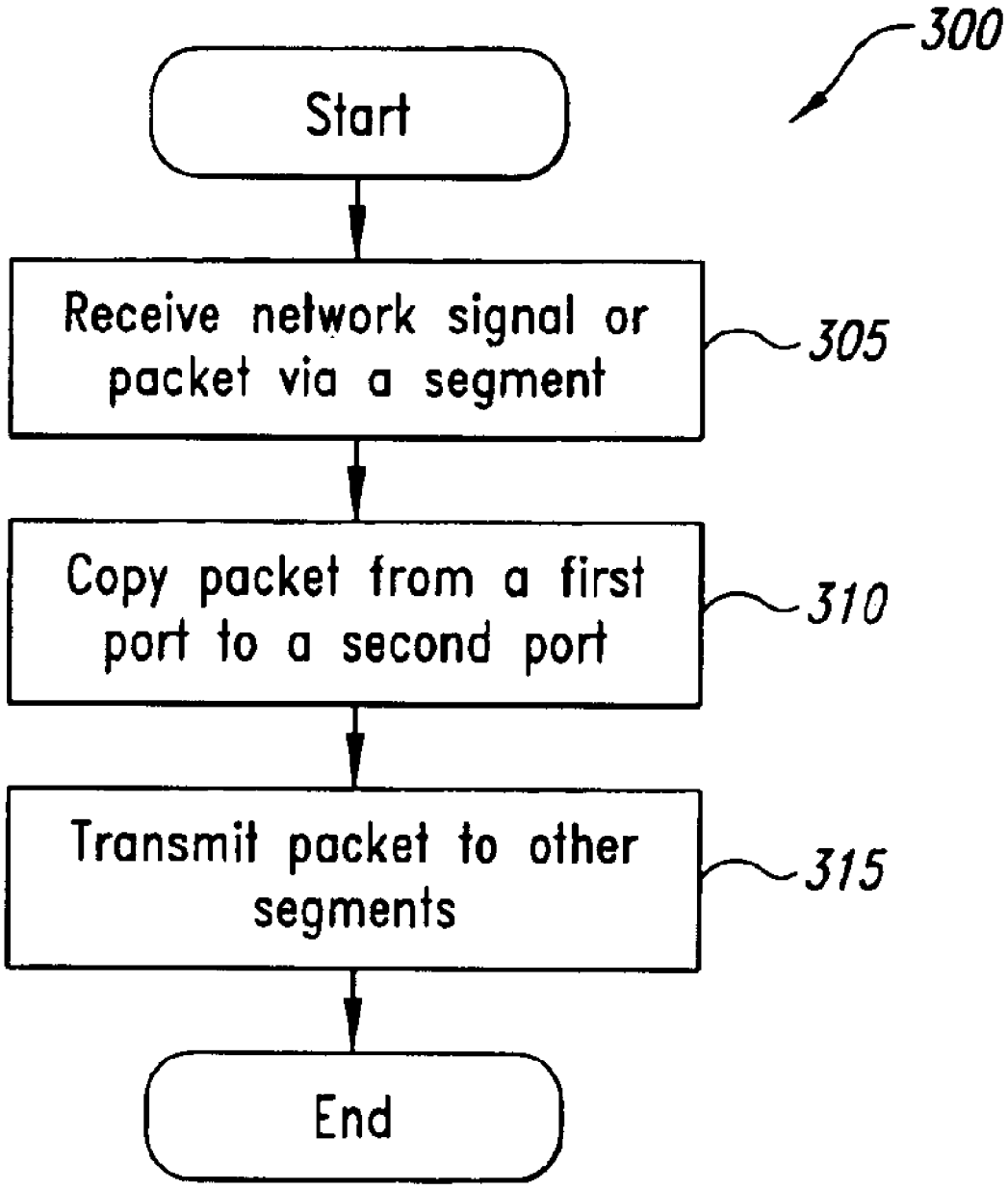
FIG. 3 is a flowchart illustrating a method of processing signals in a network, in accordance with an embodiment of the invention.

FIG. 3 is a flowchart illustrating a method 300 of processing signals in a network, in accordance with an embodiment of the invention. A network signal (such as a packet) is first received (305) by a hub with smoke detection functionality. The hub copies (310) the received packet from a first port to a second port. The hub then transmits (315) the packet from the second port to at least another segment.

Figure 4:
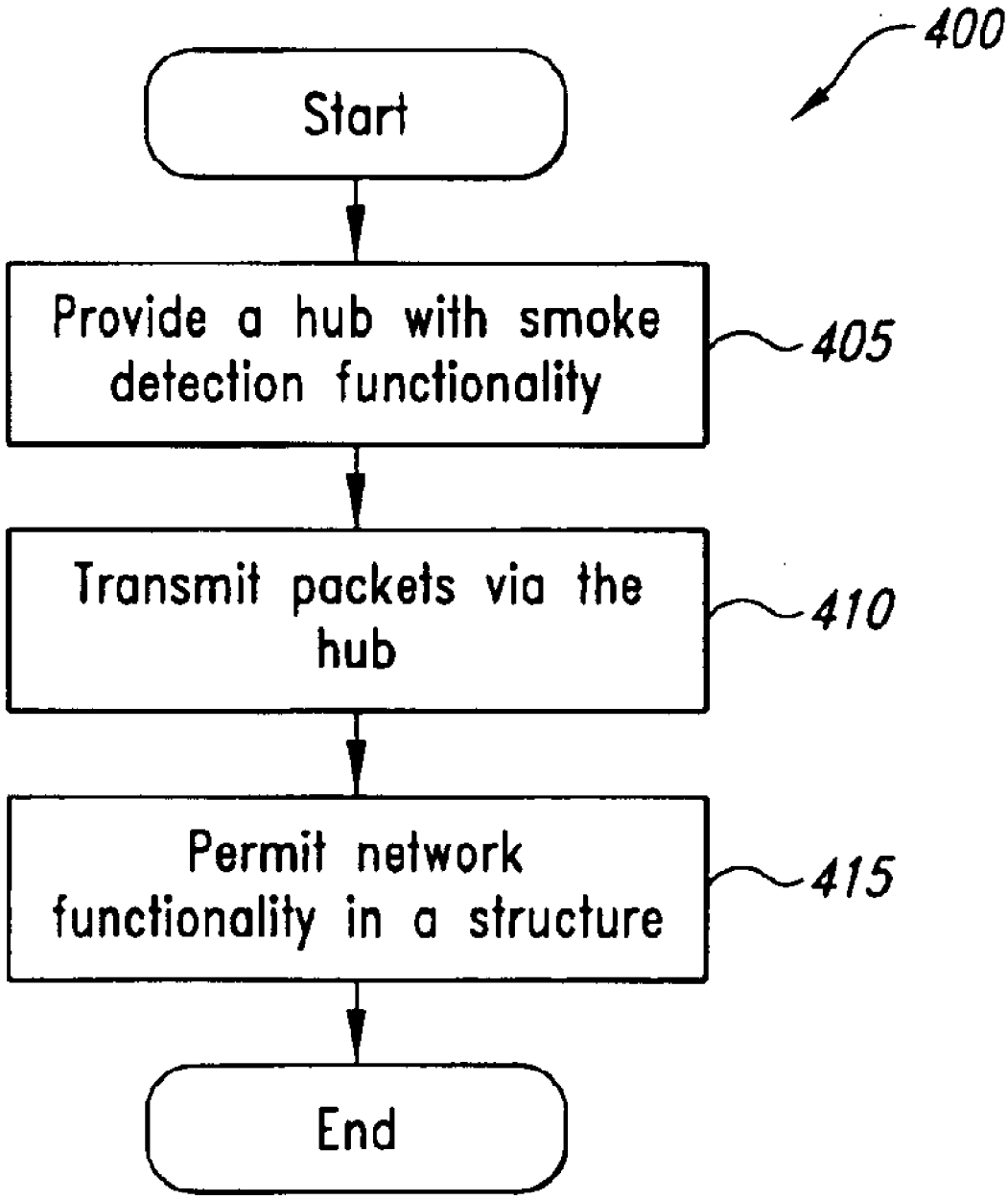
FIG. 4 is a flowchart illustrating a method of implementing a home network system, in accordance with an embodiment of the invention.

FIG. 4 is a flowchart illustrating a method 400 of implementing a home network system, in accordance with an embodiment of the invention. A hub with smoke detection functionality is provided (405). As shown in FIG. 1, in one embodiment, the hub may be connected to a smoke alarm system of a dwelling. The hub includes network hub functionality to permit the hub to provide power and/or data transmission functionality to a network in the dwelling. Thus, the hub can transmit (410) packets via the hub. The hub can permit (415) permit network functionality within a structure such as a dwelling or building. This network functionality includes, for example, home entertainment or LAN capabilities or functionalities.

The various modules discussed herein may be, for example, circuits, hardware, software, commands, data files, programs, code, instructions, or the like, or various combinations thereof. Furthermore, at least some of the components of an embodiment of the invention may be implemented by using a programmed general-purpose digital computer, by using application specific integrated circuits, programmable logic devices, or field programmable gate arrays, or by using a network of interconnected components and circuits. Connections may be wired, wireless, by modem, and the like.

It will also be appreciated that one or more of the elements depicted in the drawings/figures can also be implemented in a more separated or integrated manner, or even removed or rendered as inoperable in certain cases, as is useful in accordance with a particular application.

It is also within the scope of the present invention to implement a program or code that can be stored in a machine-readable medium to permit a computer to perform any of the methods described above. Moreover, while smoke detectors are used herein for illustrative purposes in one embodiment, it is appreciated that other embodiments may implement the hub functionality via use of other types of detectors, such as motion detectors for burglar alarm systems.

Additionally, the signal arrows in the drawings/figures are considered as illustrative and are not limiting, unless otherwise specifically noted. Furthermore, the term "or" as used in this disclosure is generally intended to mean "and/or" unless otherwise indicated. Combinations of components or actions will also be considered as being noted, where terminology is foreseen as rendering the ability to separate or combine is unclear.

As used in the description herein and throughout the claims that follow, "a,""an," and "the" includes plural references unless the context clearly dictates otherwise. Also, as used in the description herein and throughout the claims that follow, the meaning of "in" includes "in" and "on" unless the context clearly dictates otherwise.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These and other modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. An apparatus for providing hub functionality in a local area network, the apparatus comprising:

a smoke detector sensor unit including a detector module configured to provide smoke detection functionality, the smoke detector sensor unit further including a hub module configured to provide local area network hub functionality to the smoke detector sensor unit such that packets received at the smoke detector sensor unit from a first segment of a local area network are transmitted to at least a second segment of the local area network, the packets being un-elated to the smoke detection functionality of the smoke detector sensor unit, wherein the hub module of the smoke detector sensor unit includes a wireless transceiver to receive packets from a computing device in a same room as the smoke detector sensor unit to be transmitted to at least one segment of the local area network.

2. The apparatus of claim 1 wherein the hub module of the smoke detector sensor unit includes a wireless transceive to transmit and receive packets to and from the computing device to provide Internet access to the computing device.

3. The apparatus of claim 2 wherein at least one segment is a wired path.

4. The apparatus of claim 2 wherein at least one segment is a wireless path.

5. The apparatus of claim 1 wherein the smoke detector sensor unit is disposed in a dwelling.

6. A system for providing a local area network, the system comprising:

a plurality of segments configured to transmit data; and a smoke detector sensor unit coupled to at least some of the segments, the smoke detector sensor unit including a detector module configured to provide smoke detection functionality, the smoke detector sensor unit further comprising a hub module configured to provide local area network hub functionality to the smoke detector sensor unit such that packets received at the smoke detector sensor unit from a device other than the smoke detector sensor unit are transmitted to at least one segment of the local area network, the packets being unrelated to the smoke detection functionality of the smoke detector sensor unit.

7. The system of claim 6 wherein the hub module of the smoke detector sensor unit includes a wireless transceiver to receive packets from a personal computer or home entertainment system to be transmitted to at least one segment of the network.

8. The system of claim 7 wherein at least one segment is a wired path.

9. The system of claim 7 wherein at least one segment is a wireless path.

10. The system of claim 6 wherein the smoke detector sensor unit is disposed in a dwelling.

11. A method of providing hub functionality in a local area network, the method comprising:

configuring a smoke detector sensor unit to internally include smoke detection functionality;

configuring the smoke detector sensor unit to internally include local area network hub functionality for enabling network access to one or more computing devices within a room in which the smoke detector sensor unit is installed;

receiving at the smoke detector sensor unit a packet unrelated to the smoke detection functionality from a device other than another smoke detector sensor unit; and forwarding the received packet to at least one segment area the local area network.

12. The method of claim 11 wherein forwarding the the packet comprises transmitting the packet in a segment that includes wired path.

13. The method of claim 11 wherein forwarding the packet comprises transmitting the packet in a segment that includes a wireless path.

14. A method of processing signals in a network, the method comprising:

receiving, by a local area network hub, a packet from a first segment, the hub being integrated into a standard smoke detector sensor unit, the packet comprising information other than sensor readings from the smoke detector sensor unit, the packet being received from a device other than another smoke detector sensor unit;

copying the received packet from a first port to a second port of the hub; and transmitting the packet from the second port to at least another segment.

15. The method of claim 14, further comprising concurrently using the smoke detection functionality to monitor for an alarm condition while receiving, copying, and transmitting the packet.

16. The method of claim 14 wherein receiving and transmitting the packet includes receiving and transmitting the packet, via wireless first and second segments respectively.

17. The method of claim 14 wherein receiving and transmitting the packet includes receiving and transmitting the packet, via hardwire first and second segments respectively.

18. The method of claim 14, further comprising passing packets via a plurality of other hubs having smoke detection functionality.

19. The method of claim 14, further comprising passing packets via a plurality of other hubs, some hubs having smoke detection functionality and other hubs having detection functionality different from smoke detection functionality.

20. A system for providing a local area network, the system comprising:

a plurality of segments configured to transmit home entertainment data, wherein the data is configured into packets suitable for transmission via at least some of the segments, wherein the packets include information indicative of a source and a destination, wherein the packets include a payload section having packet information and a header section having control information, and wherein the segments can include wireless or hardwire path, a smoke detector sensor unit coupled to at least some of the segments, wherein the smoke detector sensor unit includes at least one port through which to couple to the segments, wherein the smoke detector sensor unit includes a detector module configured to provide smoke detection functionality and a hub module coupled to the detector module and configured to provide local area network hub functionality, wherein the smoke detector sensor unit is configured to internally include local area network hub functionality to pass packets unrelated to smoke detection functionality between segments to which it is coupled to implement a local area network within a dwelling, wherein the smoke detector sensor unit is to receive packets from a personal computer or home entertainment system to be transmitted to at least one segment of the local area network, wherein the smoke detector sensor unit is configured to concurrently use the smoke detection functionality to monitor for an alarm condition while using the local area network hub functionality, a housing integrated with the smoke detector sensor unit and structured to contain the detector module and the hub module, wherein the detector module includes a sensor structured to detect smoke indicative of the alarm condition, and an alarm coupled to the sensor to provide an audible alarm if an alarm condition is detected by the sensor.

21. The system of claim 20, further comprising additional smoke detector sensor units configured with network hub functionality and coupled to the smoke detector sensor unit via the segments, in a manner that allows packets to be passed among the smoke detector sensor units via use of their network hub functionality.

22. The system of claim 20, further comprising another detector, having a detector module having detection functionality different from smoke detection functionality, configured with a hub modules having network hub functionality and communicatively coupled to the smoke detector sensor unit via at least one of the segments to allow packets to be passed between the smoke detector sensor unit and the another detector.

23. The system of claim 22 wherein the another detector comprises a motion sensor detector.

24. The apparatus of claim 1, wherein the packets received at the smoke detector sensor unit originate from a homes entertainment system.

25. A home entertainment network comprising:

a plurality of segments configured to transmit home entertainment packets; and a plurality of smoke detector sensor units linking the segments, each smoke detector sensor unit including:

a detector module configured to provide smoke detection functionality; and a hub module configured to provide local area network hub functionality to each smoke detector sensor unit such that home entertainment packets received at the smoke detector sensor unit from a personal computer or home entertainment system are transmitted to at least one segment of the home entertainment network.

* * * * *